US005358977A

United States Patent [19]

Krankkala et al.

[11] Patent Number: 5,358,977

[45] Date of Patent: Oct. 25, 1994

[54] STABILIZED PAPER SUBSTRATE FOR RELEASE LINERS USING AROMATIC AND ALIPHATIC PRIMERS, AND NOVEL PRIMER COAT

[75] Inventors: George Krankkala, Naperville; John Bachman, Chicago, both of Ill.

[73] Assignee: Daubert Coated Products, Inc., Willowbrook, Ill.

[21] Appl. No.: 826,752

[22] Filed: Jan. 27, 1992

Related U.S. Application Data

[63] Continuation-in-part of Ser. No. 625,457, Dec. 11, 1990, Pat. No. 5,084,354, and a continuation-in-part of Ser. No. 601,409, Oct. 23, 1990, abandoned.

[51] Int. Cl.[5] ..... C08F 2/50

[52] U.S. Cl. ..... 522/100; 522/103

[58] Field of Search ..... 528/110; 522/100, 103; 523/456

[56] References Cited

U.S. PATENT DOCUMENTS

| | | | |
|---|---|---|---|
| 4,069,368 | 1/1978 | Deyak et al. | 428/420 |
| 4,273,668 | 6/1981 | Crivello | 522/31 |
| 4,284,753 | 8/1981 | Hewitt | 528/92 |
| 4,533,600 | 8/1985 | Coughlan et al. | 428/414 |
| 4,554,341 | 11/1985 | Allen | 528/89 |
| 4,622,349 | 11/1986 | Koleske et al. | 522/31 |
| 4,694,029 | 9/1987 | Land | 522/25 |
| 4,725,653 | 2/1988 | Koleske | 528/110 |
| 4,840,978 | 6/1989 | Koleske et al. | 528/250 |
| 4,859,511 | 8/1989 | Patterson et al. | 428/447 |

FOREIGN PATENT DOCUMENTS

| | | |
|---|---|---|
| 1341458 | 12/1973 | United Kingdom . |
| 8701713 | 3/1987 | World Int. Prop. O. . |
| 8803542 | 5/1988 | World Int. Prop. O. . |

*Primary Examiner*—Veronica P. Hoke

*Attorney, Agent, or Firm*—Wallenstein, Wagner & Hattis, Ltd.

[57] ABSTRACT

The invention is a method of manufacturing a substrate and, particularly, of manufacturing a release paper. The method comprises coating a release paper base with a primer coat, and curing the primer coat. The cured primer coat is then overlayed with a heat-curable or an ultraviolet-curable silicone coating which is, in turn, cured with heat or ultraviolet light. A product manufactured in accordance with this method enables a facing adhered to this release paper to be removed relatively easily from that release paper.

3 Claims, No Drawings

STABILIZED PAPER SUBSTRATE FOR RELEASE LINERS USING AROMATIC AND ALIPHATIC PRIMERS, AND NOVEL PRIMER COAT

RELATED APPLICATIONS

This application is a continuation-in-part of U.S. application Ser. No. 07/625,457, filed on Dec. 11, 1990, which is set to issue on Jan. 28, 1992, as U.S. Pat. No. 5,084,354, and of U.S. application Ser. No. 07/601,409, filed on Oct. 23, 1990, now abandoned.

TECHNICAL FIELD

This invention relates generally to coating compositions for substrates, such as release paper. In particular, the present invention relates to a release paper and a method of its manufacture, and a primer coat for use with this release paper.

BACKGROUND OF THE INVENTION

Adhesive labels and similar adhesively-secured items are generally well-known in the art. These adhesive labels usually comprise a facing for graphics, an adhesive secured to the backside of this facing, and a release liner or release paper. The adhesive must hold the facing securely to the release paper, but must permit relatively easy breakaway of the facing from the release paper when that facing is pulled away from the release paper by the ultimate user. Generally, the amount of force necessary to pull the facing away from the release paper is measured in units of "grams per inch."

It is well-known in the prior art to construct a release liner by coating that liner with a silicone release resin. The silicone release resin is applied directly to the release paper base, such as a densified kraft paper.

A silicone release liner consists of a substrate such as a paper, polyethylene coated paper, or foil that has been coated with a silicone polymer that will allow inherently tacky materials such as pressure-sensitive adhesives (PSA), sealants, caulks or resins to be easily removed from the liner. Furthermore, the silicone polymer must be sufficiently cured and adhered to the substrate so that it will not be transferred to the materials it contacts.

The silicone polymers can be applied to the substrates by various coating techniques such as Meyer rod coating, Gravure coating or air knife coating. Coatings can be suitably applied from solvents, emulsions, or they can be applied as 100 percent solids. Once coated, the silicone must be cured or crosslinked to ensure that the coating is nonmigratory and adhered to the substrate. Most silicone release polymers are cured thermally at substrate temperatures greater than 250° F. At these temperatures, paper substrates lose moisture rapidly.

The physical properties of a paper substrate rely to a large extent on moisture content. The tensile, adsorption energy, suppleness, tear strength and dimensional stability all decrease if too much moisture is lost during the curing process.

Some manufacturers of silicone release polymers have addressed the problem of high cure temperatures by functionalizing the silicone polymer with acrylic $$CH_2{=}CH\underset{\underset{O}{\|}}{C}{-}O{-}$$

groups. These polymers now can be cured with radiation techniques, such as electron beam radiation or ultraviolet light, through the assistance of a photoinitiator. To achieve adequate cure, atmospheric oxygen must be excluded from these coatings during the cure. This can be difficult to control and expensive to implement in production settings. Radiation-cured silicones of this type have not been used extensively on paper substrates because of problems associated with cure, poor performance with acrylic pressure-sensitive adhesive and the high cost of inerting and curing equipment.

In U.S. Pat. No. 4,273,668, issued to Crivello on Jun. 16, 1981, entitled "ARYLSULFONIUM SALT-SOLVENT MIXTURES," this problem was partially solved by functionalizing silicone polymers with epoxide groups which can be cured cationically under U.V. light using "onium" type photoinitiators. With this invention, manufacturers can now cure silicones with U.V. light without the expense of excluding oxygen during the cure. Silicones of this type perform well, if properly cured, with most pressure-sensitive adhesives (PSA), including acrylics. Proper cure is easily achievable on films and coated paper, but is difficult on porous substrates such as conventional release liner papers. Components of the silicone polymer or onium catalyst can penetrate the pores and capillaries of the paper and become immobilized, and are thus partially incapable of participating in the cure reaction.

In addition, the paper itself or the components introduced by the paper manufacturer during pulping and finishing processes can interfere with the cure chemistry of the silicone. An improperly cured silicone release polymer will not provide a premium release surface for PSA's, and will cause the PSA to become detackified by silicone transfer. Subsequently, this results in poor adhesive performance during readhering to other surfaces.

Until now, silicone has always been applied directly to the release paper base and cured by air or heat curing. No method existed for the ultraviolet curing or an ultraviolet-curable silicone onto a release paper base, and which permitted relatively easy release of the facing from that release paper base.

Photopolymerizable compositions similar to those used in the present invention have been described in the prior art. In particular, U.S. Pat. No. 4,593,051, issued to Koleske on Jun. 3, 1986, is entitled "PHOTOCOPOLYMERIZABLE COMPOSITIONS BASED UPON EPOXY AND POLYMER/HYDROXYL-CONTAINING ORGANIC MATERIALS." This patent shows 3,4-epoxycyclohexylmethyl-3,4-epoxycyclohexene carboxylate as a participant in photoinitiated oxonium ion intermediate addition reactions. The compositions in this patent are apparently directed to varnishes for use in the metal container, appliance, and/or automotive industries.

Other generally pertinent prior art includes U.S. Pat. No. 4,840,978, issued to Koleske et al. on Jun. 20, 1989, entitled "BLENDS OF CYCLIC VINYL ETHER CONTAINING COMPOUNDS AND EPOXIDES"; and U.S. Pat. No. 4,694,029, issued to Land on Sep. 15, 1987, entitled "HYBRID PHOTOCURE SYSTEM." Koleske et al. and Land disclose photopolymerizable compositions.

Heat-curable epoxy-styrene compositions are disclosed in U.S. Pat. No. 4,284,753, issued to Hewitt, Jr., on Aug. 18, 1981, entitled "HEAT CURABLE POLYEPOXIDE-UNSATURATED AROMATIC MONOMER RESIN COMPOSITIONS"; and U.S. Pat. No. 4,554,341, issued to Allen on Nov. 19, 1985, entitled "FIRE RETARDANT, FAST REACTING EPOXY RESIN."

U.S. Pat. No. 4,069,368, issued to Deyak, discloses ultraviolet-curable epoxy-functional silicones.

U.S. Pat. No. 4,533,600, was issued to Coughlin et al. on Aug. 6, 1985, and entitled "SEALANT SHEET MATERIAL." This patent is assigned to the assignee of the present application. The patent discloses a sheet material comprising a smooth grade of a kraft paper, a continuous coating of a resin composition on the kraft paper, and continuous film of silicone release agent on the surface of at least one of the resin composition coatings. The resin coating, however, consists essentially of a nitrile rubber modified polyvinyl chloride, and the silicone is an emulsion which is cured by heat.

Finally, U.S. Pat. No. 4,859,511, issued to Patterson et al., on Aug. 22, 1989, entitled "UNDERCOATED SILICONE RELEASE SHEET," describes release sheets having a low polar surface energy hydrocarbon undercoating. This undercoating, which has a low elastic modulus, is interposed between the substrate and a silicone release coating. As may be seen from the examples and claims, however, the undercoating of this patent is substantially different from the present undercoating or primer coat as described below.

SUMMARY OF THE INVENTION

The invention is a method of manufacturing a substrate treated with an ultraviolet light-curable silicone. The preferred substrate is a release paper base. The method comprises coating the release paper base with a primer coat, and it has now been discovered that this primer coat can be based upon an aromatic or aliphatic substance. The aromatic or aliphatic primer coat may be cured in a conventional manner, that is, with heat or air curing, or it may be alternatively cured with ultraviolet light. By treating the release paper base with an aromatic or aliphatic primer coat in accordance with the invention, the surface of the paper is properly prepared for an ultraviolet-curable silicone coating. After the ultraviolet-curable silicone coating is placed over the primer coat-treated substrate, the silicone coating itself is cured with ultraviolet light. For example, when an adhesively-secured facing is pulled away from a release paper treated in this manner, the force necessary to pull the facing away will not exceed 35 grams per inch, even after aging.

The invention is also an ultraviolet-cured substrate and the primer coat for that substrate. The substrate is a release paper comprising a primer coat that may be cured by ultraviolet radiation or by more conventional means, and an overlaying ultraviolet-curable silicone coating. When an adhesively-secured facing is secured to this treated release paper base, that facing may be removed from the release paper with a force not exceeding 35 grams per inch.

This invention describes a method of preparing a paper substrate to make it compatible for use with radiation-cured silicones as described in the literature by Crivello and others.

The method comprises coating a paper as supplied by the manufacturer with an aromatic or aliphatic primer coat. The primer coat serves to prevent the silicone coating from penetrating the paper, which can result in the silicone becoming unavailable for cure. The aromatic or aliphatic primer coat also insulates the silicone from deleterious cure-inhibiting components which can be introduced during the paper making process.

The composition of the aliphatic or aromatic primer coat can vary as long as it does not contain components deleterious to the cure for silicones. Further, the primer coat should be crosslinked to an extent so that it cannot be dissolved, swollen or fused by solvents. This allows for heat to be used in the adhesive coating for the finished liner, as the primer does not melt at temperatures in excess of 400° F.

The primer coat may be cured in a conventional manner, that is with heat or air curing or it may be alternately cured with ultraviolet light or other radiative processes such as electron beam curing methods. The radiation processes are preferred since they do not result in moisture loss from the paper substrates. As described earlier, moisture loss during cure can result in unstable or unusable paper liner.

Once cured on the paper on both sides, the primer is a barrier trapping moisture in the paper and preventing water and atmospheric moisture from invading the paper, which causes instability. The cured primer also serves to mechanically enhance the physical properties of the paper such as tensile strength, stiffness and dimensional stability.

The aromatic or aliphatic primer coat, because it seals and tensilizes the paper, allows the use of less expensive papers than could otherwise be used in a silicone coating operation.

The aromatic or aliphatic primer can be applied to one or both sides of the paper and be overcoated on one or both sides with the same U.V.-cured silicone. It can also be overcoated on one side with a U.V.-cured silicone with a stable release of less 35 grams per inch, and on the other with a U.V. silicone composition with a stable release value between 75 and 100 grams per inch, to produce a differential release liner with many industrial applications.

Liners of this type are used to produce self-wound adhesive transfer tapes, carbon composite structures, and many types of sealants or caulks.

Accordingly, an object of this invention is a method of treating a release paper base with a U.V.-curable silicone which permits relatively easy separation of an adhesively-secured facing from that release paper.

A further object of the invention is a primer coat and a release paper which, when treated, inhibits moisture loss and results in a more stable cellulosic substrate.

DETAILED DESCRIPTION OF THE PREFERRED EMBODIMENT

This invention is a method of manufacturing an ultraviolet-cured substrate, such as a release paper. One suitable release paper is a densified kraft paper, such as XCT-157 densified kraft paper manufactured by the Nicolet Paper Company. Any similar kraft paper, however, whether bleached or unbleached, will be suitable. One ream of paper is 3,000 square fee, and XCT-157 has a weight of 60 pounds per ream.

EXAMPLE 1

A suitable primer coat is necessary to properly prepare this kraft paper for the subsequent ultraviolet-curable silicone coating. In this embodiment, the primer coat may be manufactured using an epoxy, a reactive diluent, a surfactant, and a catalytic blend that acts as the photoinitiator. One suitable primer is manufactured from the following components, each being listed by weight:

Components of Stabilizing Primer Coat 75.0 parts of epoxy 25.0 parts of reactive diluent 0.5 parts surfactant 3.0 parts photoinitiator (50% in propylene carbonate)

The epoxy may be either Araldite 6010, manufactured by Ciba-Geigy, or Shell Product No. 828. These formulations have the general formula:

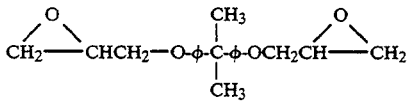

This composition is a glycidyl-type epoxide, preferably diglycidyl ethers of bisphenol A which are derived from bisphenol A and epichlorohydrin.

The reactive diluent is Cyracure 6200, manufactured by Union Carbide, or its equivalent. Cyracure 6200 comprises 50 percent by weight 3,4-epoxycyclohexylmethyl-3,4-epoxycyclohexene carboxylate:

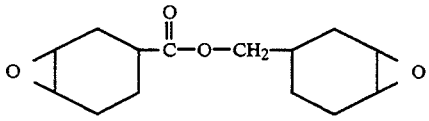

45 percent 4-vinyl cyclohexene monoepoxide:

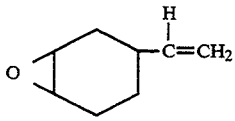

and 5 percent polycapralactone.

The surfactant is Surfynol 104E, or an equivalent. Surfynol comprises 50 percent ethylene glycol and 50 percent:

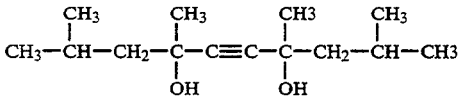

Finally, the photoinitiator is Cyracure 6990, manufactured by Union Carbide, or a similar catalytic blend. Cyracure 6990 is a combination of 50 percent triphenyl sulfonium hexaflurophosphate and 50 percent propylene carbonate.

When these four components are combined, they are stirred with a magnetic stirrer or air mixer at room temperature, until a clear solution is obtained. A clear solution can usually be achieved within ten minutes. This combination is suitable for use as the prime coat, and is stable over a period of approximately one week. The coating composition comprising these four parts will be referred to as the "stabilizing prime coat."

A Nicolet XCT-157 densified kraft paper may be used to manufacture the substrate in accordance with the invention. It will be understood by those in the art, however, that any other similar paper, whether bleached or unbleached, may be used. Other suitable papers include machine glazed, machine finished, supercalendared, parchment, vellum, and any other paper having a Gurley porosity, when measured on a Gurley tester Model No. 4200, of at least 300 seconds per 100 cc. of air. In this embodiment, the XCT-157 kraft paper has a basis weight of 60 pounds per ream.

Using a Meyer No. 3 rod, the densified kraft paper is coated with the stabilizing prime coat described above in a coating weight of 2 to 5 pounds of stabilizing prime coat per ream of paper. The stabilizing prime coat is then cured in a Fusion System F-300 ultraviolet processor set at its full power of 300 watts per inch, and with the conveyor belt moving at a speed of 100 feet per minute.

After the stabilizing prime coat on one side of the substrate has been cured, the same stabilizing prime coat in the same amount is applied to the opposite side the substrate densified kraft paper. In this step, the stabilizing prime coat is again applied at 2 to 5 pounds per ream, and the treated substrate is again sent through the Fusion System F-300 processor at full power and with a conveyor belt speed of 100 feet per minute.

This densified kraft paper which has been coated with the stabilizing prime coat is then, in turn, coated on its first side with an ultraviolet-curable silicone, such as General Electric Silicone Product No. U.V. 9300. This U.V.-curable silicone may be applied, at 0.40–1.00 pounds per ream, to the treated densified kraft using a Euclid knife-over roll coater and at a knife pressure of 25 p.s.i. The Euclid coater is manufactured by Euclid Machines, Bay City, Mich. The silicone-coated side of the densified kraft paper is then cured in the Fusion System F-300 processor, again at full power and with a conveyor belt speed of 100 feet per minute. The paper is then reversed and treated on its second side with the General Electric ultraviolet light-curable silicone, using the same amount of silicone, the same apparatus, and the same knife pressure as described above for the ultraviolet coating on the first side of the kraft paper. The second side of the kraft paper is cured in the same manner as the first side of the paper, i.e., in the Fusion System F-300 U.V. processor at full power, and at a conveyor belt speed of 100 feet per minute.

As may be seen from the below Table I, kraft papers that are treated with the stabilizing prime coat, and kraft papers that are treated with both the stabilizing prime coat and the ultraviolet-curable silicone coating with the process described above, both show smaller width expansions, in the cross-machine (CM) direction, than Nicolet XCT-157 kraft which has not been so treated:

TABLE I

| Neenah Expansimeter Expansions | Percent (%) |
|---|---|
| Nicolet (densified kraft) XCT-157 60 lbs./ream | 1.51 |
| (densified kraft treated on both sides with stabilizing prime coat) | .88 |
| (densified kraft treated on both sides with stabilizing prime coat and silicone coating, GE U.V. curable) | .88 |

The test procedure for determining the percent expansion of the untreated paper, the paper treated with a stabilizing prime coat, and the paper treated with both the stabilizing prime coat and the silicone is as follows:

Neenah Expansimeter Test Conditions

1. The samples are aged under TAPPI conditions of 70° F., 50 percent relative humidity for twenty-four hours. Samples are cut to 1 inch width and 11 inches in length.

2. The samples are then placed in a Neenah chamber set at 11 percent R.H., and 70° F. for twenty-four hours. At the end of this test interval, the sample length is measured with the caliper gauge within the Neenah unit. This dimension is $M_1$.
3. The samples are then placed in the Neenah chamber set at 84 percent R.H., 70° F. for twenty-four hours. At the end of this test interval the sample length is measured with the caliper gauge within the Neenah unit. This dimension is $M_2$.
4. The percent expansion is calculated as follows:

$$\frac{M_2 - M_1}{M_1} \times 100$$

The lower the percent expansion, the less moisture the substrate adsorbed, and the more stable the paper for subsequent process applications. From this, it is apparent that the treated paper is superior to the untreated paper.

As may also be seen by Table II below, the silicone-coated and stabilized prime coat, densified kraft paper described above shows initial and aged release parameters well below those for the same paper which has not been treated with a stabilizing prime coat:

TABLE II

| | Release Data | |
|---|---|---|
| | Initial | Aged |
| Silicone Coated Stabilized Prime Coat Densified Kraft | 16.8 grams/ inch of width | 23.6 grams/ inch of width |
| Silicone Coated Densified Kraft without Stabilizing Prime Coat | 50.0 grams/ inch of width | 150.0 grams/ inch of width |

The procedure used in measuring the release is as follows:

1. Ashland 1910 (acrylic) adhesive is applied over the silicone coated product produced in Example #2, with a laboratory knife-over-bed coater in which the gap is set at 0.008 inches. This results in a wet cast adhesive film 0.008 inches thick.
2. The adhesive coated product of Example #2, with the wet cast adhesive of Step 1, is cured at 150° F. for 10 minutes.
3. The cured adhesive is laminated to 0.001 inch thick polyester equivalent to DuPont "mylar."
4. After lamination, samples are cut into strips 1 inch width and 11 inches in length.
5. At least two such strips are evaluated for release initially using an I-Mass Peel Tester made by Instrumentors, Inc., Model #3M-90, set at 180° peel and 90 inches/minute stripping speed. These release force measurements are averages and reported as "initial" in grams per inch of width.
6. At least two strips prepared in Steps 1–4 are placed in an oven maintained at 70° C. for seventy-two hours. These strips are then evaluated for aged release also using the I-Mass Peel Tester under identical settings as described in Step 5. These release force measurements are averaged and as "aged" in grams per inch of width.

The lower the force in grams per inch, the more preferable the treated paper.

From the above, it is plain that when a kraft paper is treated with a U.V.-curable silicone coating, but without the stabilizing prime coat, the release measurements are well in excess of the desired 35 grams per inch. In contrast, when this same product has been pretreated with the stabilized prime coat described above, the release measurements are well under 35 grams per inch.

A differential release sheet is one having a release value of less than 35 grams on one side, and having a release value greater than 35 grams (tight release) on the other side. Typical tight release values in the industry range from 40–300 grams.

EXAMPLE 2

A densified kraft is coated on both sides with the primer coat, as described above. One side is subsequently coated with the G.E. U.V.-cured silicone, again as described above. The second side, however, is coated with a blend of polymers. In this example, the blend comprises 60 percent GE-9320 and 40 percent GE9315. This coating can be applied using the Euclid knife over roll coater, using the same conditions as described in the previous Example, and then cured using those same conditions. This particular mixture was formulated to give a "tight," stable release value approximately four (4) times greater than that of the "easy" release value, as may be seen in Table III.

TABLE III

| | Differential Release Data | |
|---|---|---|
| | Initial | Aged |
| Easy Release Coated Stabilized Prime Coat Densified Kraft | 15.8 grams/ inch of width | 21.0 grams/ inch of width |
| Tight Release Coated Stabilized Prime Coat Densified Kraft | 60.0 grams/ inch of width | 100.0 grams/ inch of width |

EXAMPLE 3

The cure of the U.V. silicone is dependent on the generation of a strong acid. The pH of the substrate to which the coating is applied can greatly affect the cure rate and cure completion. A specific example is a paper from Glatfelter Paper Co. (Release Liner Base II, Mfg. Code 87660). This paper has a pH of 9.3. When the U.V.-curable silicone is applied directly to the paper and processed under U.V. light, the cure is completely inhibited. This inhibition is a direct result of the high pH of the substrate, where the acid catalyst is consumed by paper instead of the polymer. When the primer coat of Examples 1 and 2 are applied to the same paper, however, the U.V.-curable silicone can be applied and cured as described in those Examples. The silicone has a stable release below the specified maximum requirement of 35 grams per inch.

TABLE IV

| | Initial | Aged |
|---|---|---|
| Silicone Coated Glatfelter Paper (w/o prime coater) | No cure | No cure |
| Silicone Coated Stabilized Prime Coat Glatfelter Paper | 14.6 grams/ inch of width | 19.5 grams/ inch of width |

EXAMPLE 4

A prime coat-treated substrate as described in Example may be subsequently coated with a 100 percent solids, thermally-cured silicone. A suitable silicone formulation is:

| | |
|---|---|
| Dow Corning 7610 | 100 parts |
| Dow Corning 7611 | 3.7 parts |
| Dow Corning 7127 | 1.59 parts |

This formulation can be applied with the Euclid knife over roll coater at a blade pressure of 32 psi. The coated paper is then cured in a forced air oven 15 250° F. for 15 seconds. The resulting product may be tested for release, as described in Table V. The results of this test are as follows:

TABLE V

| | Initial | Aged |
|---|---|---|
| 100% Silicone Treated Stabilized Prime Coat Densified Kraft | 21.0 grams/ inch of width | 33.0 grams/ inch of width |

EXAMPLES 5–9

In addition to the aromatic primer coat used in the above-described Examples, aliphatic primer coats have been found to provide slightly improved results. In particular, a primer coat made from a dicyclohexyl epoxy, such as 3,4-epoxycyclohexylmethyl-3,4-epoxycyclohexene carboxylate ("epoxy"), has been found suitable for the manufacture of stabilized paper substrates:

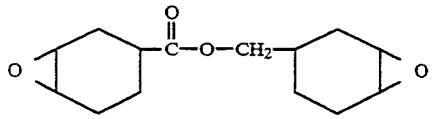

One suitable reactive diluent is 4-vinyl cyclohexene monoepoxide:

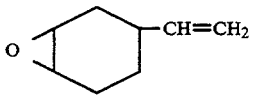

The aliphatic-based primer coat used in these Examples was manufactured in accordance with the following specifications. To the formulations listed below, there was added 0.5 parts of a surfactant and 3.0 parts of a photoinitiator (50 percent in propylene carbonate). The surfactant is Surfynol 104E and the photoinitiator is Cyracure 6990, manufactured by Union Carbide, or a similar catalytic blend. As stated above, Cyracure 6990 is a combination of 50 percent triphenyl sulfonium hexaflurophosphate and 50 percent propylene carbonate:

Example 5, 100.0 parts epoxy, 0 parts of the reactive diluent 4-vinyl cyclohexene, monoepoxide.

Example 6, 90.0 parts epoxy, 10.0 parts of this same reactive diluent.

Example 7, 80.0 parts epoxy, 20.0 parts reactive diluent.

Example 8, 70.0 parts epoxy, 30.0 parts reactive diluent.

Example 9, 60.0 parts epoxy, 40.0 parts reactive diluent.

Other reactive diluents believed to be suitable include Epodil 747, an aliphatic glycidyl ether, and Epodil 750, a diglycidyl ether of 1,4-butanediol. Both of these are available from Pacific Anchor Chemical.

After the formulations of these Examples 5–9 were blended in accordance with the instructions for the blending of the formulation of Example 1, they were tested to determine their efficacy. The primer coatings of Examples 5–9 were coated onto the paper substrates at approximately 4 pounds per ream. Then, the hydroexpansivity tests like those discussed above were done to determine the suitability of the primer coat. The aliphatic primer coat proved to result in slight improved dimensional stability, as shown in Data Columns 3 and 4 of Table VI.

The epoxy component of this stabilizing primer coat is highly reactive and can participate in radiation-cured reaction mechanisms with additional molecules of identical primer epoxy components. The epoxy component can also react with the reactive diluent and with the hydroxyl groups of the base paper to form a stabilized, highly crosslinked network.

EXAMPLES 10–14

In addition to the above aromatic primer coat/diluent combination used in Examples 1–4, another aromatic primer coat/diluent combination has been found to provide substantially improved results. In particular, a primer coat made from Araldite 6010 ("the epoxy") and the reactive diluent, 4-vinyl cyclohexene monoepoxide, has been found suitable for the manufacture of stabilized paper substrates.

The aromatic-based primer coat used in these Examples was manufactured in accordance with the following specifications. To the formulations listed below, there was added 0.5 parts of a surfactant and 3.0 parts of a photoinitiator (50 percent in propylene carbonate). The surfactant is Surfynol 104E and the photoinitiator is Cyracure 6990, manufactured by Union Carbide, or a similar catalytic blend. As stated above, Cyracure 6990 is a combination of 50 percent triphenyl sulfonium hexaflurophosphate and 50 percent propylene carbonate:

Example 10, 100.0 parts epoxy, 0 parts of the reactive diluent 4-vinyl cyclohexene monoepoxide.

Example 11, 90.0 parts epoxy, 10.0 parts of this same reactive diluent.

Example 12, 80.0 parts epoxy, 20.0 parts reactive diluent.

Example 13, 70.0 parts epoxy, 30.0 parts reactive diluent.

Example 14, 60.0 parts epoxy, 40.0 parts reactive diluent.

Other reactive diluents believed to be suitable include Epodil 747, an aliphatic glycidyl ether, and Epodil 750, a diglycidyl ether of 1,4-butanediol. Both of these are available from Pacific Anchor Chemical.

After the formulations of these Examples 10–14 were blended in accordance with the instructions for the blending of the formulation of Example 1, they were tested to determine their efficacy. The primer coatings of Examples 10–14 were coated onto paper substrates at approximately 4 pounds per ream. Then, the hydroexpansivity tests like those discussed above were done to determine the suitability of the primer coat. The aliphatic primer coat proved to result in substantially improved dimensional stability, as shown in Data Columns 1 and 2 of Table VI.

TABLE VI

Dimensional stability data are reported as % hydroexpansivity and are the average of two replicates.
Trial 1 humidity range: 16.0–84.5% rh
Trial 2 humidity range: 20.0–85.0% rh
40 BKGF (Bleached Densified Kraft) raw stock dimensional stability: 0.98%

| % VCMX Mono Function Diluent* | Data Column 1 Dimensional Stability VCMX in 6010/Trial 1 | Data Column 2 Dimensional Stability VCMX in 6010/Trial 2 | Data Column 3 Dimensional Stability VCMX in 6110/Trial 1 | Data Columm 4 Dimensional Stability VCMX in 6110/Trial 2 |
|---|---|---|---|---|
| 0.0% | M | M | 0.94% | 0.92% |
| 10.0% | 0.75% | 0.68% | 0.94% | 0.88% |
| 20.0% | 0.76% | 0.74% | 0.96% | 0.94% |
| 30.0% | M | 0.70% | 0.95% | 0.96% |
| 40.0% | 0.78% | 0.74% | 1.00% | 0.94% |

*4-vinyl cyclohexene, monoepoxide
M = unavailable

The epoxy component of this stabilizing primer coat is highly reactive and can participate in radiation-cured reaction mechanisms with additional molecules of identical primer epoxy components. The epoxy component can also react with the reactive diluent and with the hydroxyl groups of the base paper to form a stabilized, highly crosslinked network.

Additional Testing On Compositions of Examples 5–14

Additional tests showed the suitability and improved results obtained with the primer coats of the invention. Particularly, the tests of Table VII were performed to determine moisture vapor transmittance.

TABLE VII

Moisture Vapor Transmittance data are reported as grams weight loss/square meter/24 hours. Numbers are an average of three replicates.
Moisture vapor transmittance of 40BKGF raw stock = 1218 g/m$^2$/24 hrs.

| % VCMX (4-vinyl cyclo-hexene) | Data Column 1 Moisture Vapor Transmittance VCMX in 6010 | Data Column 2 Moisture Vapor Transmittance VCMX in 6110 | Data Column 3 Coughlin Primer Acrylic Polymer Coated from an Emulsion |
|---|---|---|---|
| 0.0% | 119.3 g/m$^2$/24 hrs. | 414.1 g/m$^2$/24 hrs. | 987 g/m$^2$/24 hrs. at 0% VCMX |
| 10.0% | 219.9 | 414.1 | |
| 20.0% | 215.2 | 372.0 | |
| 30.0% | 215.2 | 332.2 | |
| 40.0% | | 374.3 | |

This transmittance may be loosely correlated with dimensional stability of treated kraft paper. Data Column 2 of Table VII shows that aliphatic composition of Examples 5–9 provided higher vapor transmittance than the aromatic composition of Examples 10–14 shown in Column 1. The compositions of both Examples 5–9 and 10–14, however, provide vastly superior resistance over both (1) a prior art primer, as shown in Data Column 3 of Table VII, and (2) a 40 BKGF raw (primer-free) stock, as shown immediately above the Data Columns. The data in Data Column 3 of Table VII describes the results of coating raw stock with a primer from Coughlin, U.S. Pat. No. 4,533,600.

Tensile strength also improved, as demonstrated in Table VIII.

TABLE VIII

Tensile data are reported as pounds/width at break point. Numbers are an average of 5–9 replicates.
40 BKGF raw stock tensile data (MC/CD): 43.56/23.65

| % VCMX (4-vinyl cyclohexene) | Data Column 1 MD Tensile Strength VCMX in 6010 | Data Column 2 CD Tensile Strength VCMX in 6010 | Data Column 3 MD Tensile Strength VCMX in 6110 | Data Column 4 CD Tensile Strength VCMX in 6110 |
|---|---|---|---|---|
| 0.0% | 58.18#/in. | 29.06#/in. | 57.11#/in. | 26.79#/in. |
| 10.0% | 57.03 | 27.67 | 57.38 | 27.50 |
| 20.0% | 55.13 | 26.84 | 56.67 | 27.24 |
| 30.0% | 55.78 | 26.81 | 56.69 | 26.82 |
| 40.0% | 53.76 | 26.04 | 55.27 | 26.45 |

As indicated directly above the columns of this Table, raw stock showed a machine direction (MD) tensile strength of 43.56 pounds per inch width at the break point, and a cross direction (CD) tensile strength of 23.65 pounds per inch. Data Columns 1 and 2 of Table VIII show that the aromatic compounds of Examples 5–9 exhibited a minimum of 53.76 (MD) and 26.04 (CD) pounds per inch width at the break point. Data Columns 3 and 4 of Table III show that the aliphatic compounds of Examples 5–9 exhibited a minimum of 55.27 (MD) and 26.45 (CD) pounds per inch width at the break point. A comparison of these Data Columns 1–4 show that the tensile strength improvements resulting from coating with the aliphatic and aromatic compounds are generally similar in magnitude.

TABLE IX

Release data are reported as grams release force/inch of width and are the average of two replicates. Samples aged for 72 hours at 70° C. Samples tested at a stripping speed of 90 ipm and a peel angle of 180°.

| % VCMX (4-vinyl cyclohexene) | Data Column 1 Si Ct. Wt. VCMX in 6010 | Data Column 2 Release VCMX in 6010 | Data Column 3 Si Ct. Wt. VCMX in 6110 | Data Column 4 Release VCMX in 6110 | Data Column 5 Release VCMX in Coughlin Type Primer |
|---|---|---|---|---|---|
| 0.0% | 0.3264#/R | 16.2 g/in. | 0.5444#/R | 21.7 g/in. | Paper delamination resulted because release value was too high at 0% VCMX. |
| 10.0% | 0.6094 | 23.8 | 0.6288 | 15.6 | |
| 20.0% | 0.5784 | 11.5 | 0.5723 | 14.8 | |
| 30.0% | 0.5758 | 20.6 | 0.5735 | 20.3 | |
| 40.0% | 0.6880 | 14.4 | 0.6479 | 20.4 | |

(Prime coat was coated at approximatety 4 lbs./ream on each side of the paper.)

A review of Table IX shows that the release values of the U.V.-cured prime coat-treated paper was well below the 35 gram per inch standard sought by the inventors. Particularly, the aliphatic-based primer of Examples 5–9 provides release forces of between 14.8 and 21.7 grams per inch of width. The aromatic-based primer of Examples 10–14 provides release forces of between 11.5 and 23.8 grams per inch. In contrast, as indicated in Data Column 5 of Table IX, the same type paper treated with a primer of the Coughlin type delaminated during a pull test.

In conclusion, the data of Tables VIII and IX demonstrate that aliphatic primer coats (Examples 5–9) result in both enhanced tensile strength and lowered release. Thus, these aliphatic primer coats provide improvements over prior art silicone release-type primers. It appears that the aromatic components of the primer coat have a greater influence on the dimensional stability of the base paper and on the ability of the base paper to minimize moisture vapor transmission.

While the specific embodiments have been illustrated and described, numerous modifications come to mind without markedly departing from the spirit of the invention. The scope of protection is, thus, only intended to be limited by the scope of the accompanying claims.

What I claim is:

1. A primer coat for the preparation of kraft paper, said primer coat consisting essentially of at least 72.5% of an epoxy compound having two or more epoxy groups; a reactive diluent, said reactive diluent selected from the group including 4-vinyl cyclohexene monoepoxide, aliphatic glycidyl ether, or a diglycidyl ether of 1,4-butanediol; a surfactant; and a photoinitiator.

2. The primer coat of claim 1, wherein said epoxy is selected from the group including glycidyl ethers of bisphenol A and dicyclohexyl epoxy.

3. The primer coat of claim 2, wherein said dicyclohexyl epoxy is 3,4-epoxycyclohexylmethyl-3,4-epoxycyclohexene carboxylate.

* * * * *